US006042161A

United States Patent [19]

Mantarakis et al.

[11] Patent Number: 6,042,161

[45] Date of Patent: Mar. 28, 2000

[54] VARIABLE POSITION LOCK ACTUATOR

[75] Inventors: Petros Z. Mantarakis, Northridge; Donald A. Becken, Burbank, both of Calif.

[73] Assignee: Reflectolite Products, Pacoima, Calif.

[21] Appl. No.: 09/073,203

[22] Filed: May 4, 1998

[51] Int. Cl.[7] ..... B65D 33/30

[52] U.S. Cl. ..... 292/253; 292/336.3; 292/DIG. 46; 292/DIG. 60; 403/76

[58] Field of Search ..... 292/253, DIG. 46, 292/336.3, 100, 200, 244, 245, DIG. 33, DIG. 60, DIG. 54, DIG. 30; 403/76, 164, 114, 113

[56] References Cited

U.S. PATENT DOCUMENTS

| | | | |
|---|---|---|---|
| 1,840,236 | 1/1932 | Kimball . | |
| 2,379,326 | 6/1945 | Voight | 292/173 |
| 2,599,054 | 6/1952 | Gates et al. | 292/348 |
| 3,037,799 | 6/1962 | Mulac | 403/113 |
| 3,387,876 | 6/1968 | Lyons, Jr. | 292/348 |
| 4,050,272 | 9/1977 | Tanaka | 70/100 |
| 4,160,560 | 7/1979 | Hauber | 292/101 |
| 4,358,874 | 11/1982 | Kaiser | 24/90.5 |
| 4,405,164 | 9/1983 | Lint et al. | 292/169.21 |
| 4,432,576 | 2/1984 | Wartian | 292/357 |
| 4,486,116 | 12/1984 | Sassi | 403/367 |
| 4,552,480 | 11/1985 | McIntyre | 403/76 |
| 4,656,849 | 4/1987 | Rotondi et al. | 70/134 |
| 4,763,935 | 8/1988 | Bisbing | 292/66 |
| 4,906,036 | 3/1990 | James | 292/202 |
| 4,927,199 | 5/1990 | Wu et al. | 292/337 |
| 5,002,419 | 3/1991 | Eustache | 403/71 |
| 5,080,407 | 1/1992 | Evers | 292/241 |
| 5,125,703 | 6/1992 | Clancy et al. | 292/337 |
| 5,409,332 | 4/1995 | Chabot, Jr. et al. | 403/114 |
| 5,540,514 | 7/1996 | Demars et al. | 403/388 |
| 5,595,409 | 1/1997 | Fier et al. | 292/112 |
| 5,609,372 | 3/1997 | Ponelle | 292/200 |

FOREIGN PATENT DOCUMENTS

| | | | |
|---|---|---|---|
| 3131182 | 3/1983 | Germany | 292/336.3 |
| 1282965 | 1/1987 | U.S.S.R. | 403/164 |

*Primary Examiner*—B. Dayoan
*Assistant Examiner*—Clifford B Vaterlaus
*Attorney, Agent, or Firm*—Hill & Simpson

[57] ABSTRACT

A flexible coupling is provided for a lock actuator and a latch assembly. The coupling is particularly useful for sliding glass doors and enables the actuator to be mounted to the door in an axially offset relationship with respect to the connecting member of the latch assembly. The coupling includes a male member that includes an outwardly protruding knuckle that is pivotally and frictionally received in the socket of a female member. The male member is connected to either the lock actuator or the latch assembly while the female connector is connected to the other of the lock actuator or the latch assembly. Rotation of the lock actuator results in rotation of both the male and female member thereby resulting in rotation of the connecting member of the latch assembly even though the actuator is disposed offset from the connecting member.

8 Claims, 2 Drawing Sheets

VARIABLE POSITION LOCK ACTUATOR

BACKGROUND OF THE INVENTION

Field of the Invention

The present invention relates generally to door hardware assemblies and, more particularly, to door hardware assemblies for use with sliding doors or sliding panels. Still more specifically, the present invention relates to a hardware assembly with a flexible coupling which enables the installation of the lock actuator in an axially offset relationship with respect to the latch assembly.

Sliding glass doors are used in both commercial and residential buildings. The current trend in the design of sliding glass doors is to expand the surface area of the glass and design the supporting frame to be as thin and discreet as possible. While this current design is viewed as being more attractive than older doors with thicker, wider frames, the current design poses problems for the installation of the door hardware and, more specifically, the lock assemblies.

For example, the narrow door frames currently employed provide little room for the installation of a mortise lock and lock actuator. Often, the lock actuator must be installed in a non-centered position on the door frame in order to access the mortise lock. The off-center positioning of the actuator or lock handle is unattractive and therefore unsatisfactory to many door designers.

Similarly, the thin or narrow door frames often require the actuator or thumbturn for a simple latch to be installed in an off-center relationship with respect to the frame. One solution to this problem is disclosed in U.S. Pat. No. 5,125,703 which discloses a door handle assembly featuring an actuator that is slidably mounted in an elongated transverse slot. The use of the transverse slot enables the door assembly to be adaptable to a wide variety of door installations and door hardware. Further, the slot enables the actuator to be mounted in a central position on the door frame but enables the actuator to be moved in a lateral direction in order to ensure that the latching mechanism engages the catch when the door is closed.

However, the employment of the transverse elongated slot disclosed in U.S. Pat. No. 5,125,703 also requires modification of the outer escutcheon plate. Further, the actuator or handle must also be specially designed so as to ensure that it covers the elongated transverse slot.

Accordingly, there is a need for other solutions to the problem of providing an aesthetically pleasing lock assembly for sliding glass doors with narrow frames that requires the actuator to be mounted onto the door frame in an axially offset relationship with respect to the latch assembly.

SUMMARY OF THE INVENTION

The present invention satisfies the aforenoted needs by providing a flexible coupling for a lock actuator and a latch assembly. The coupling of the present invention comprises a male member comprising an outwardly protruding knuckle that is pivotally and frictionally received in the socket of a female member. The male member is connected to either the lock actuator or the latch assembly. On the other hand, the female member is connected to the other of the lock actuator or latch assembly. As a result, the lock actuator and latch assembly may be arranged in an offset relationship with respect to one another due to the flexible coupling provided by the male and female members. Rotation of the lock actuator will result in rotation of the male and female members and therefore rotation of the latch assembly.

In an embodiment, the female member is connected to the lock actuator and the male member is connected to the latch assembly.

In an embodiment, the male member is connected to the lock actuator and the female member is connected to the latch assembly.

In an embodiment, the actuator comprises a handle or thumbturn and the latch assembly comprises a mortise lock.

In an embodiment, the latch assembly comprises a hook-shaped latch member.

It is therefore an advantage of the present invention to provide a flexible coupling for a lock actuator and latch assembly for a sliding glass door which enables the lock actuator, or handle, to be mounted to the frame of the door in an axially offset relationship with respect to the latch assembly.

Yet another advantage of the present invention is that it provides an improved door handle assembly for a sliding glass door with thin door frames.

Still another advantage of the present invention is that it provides an improved door handle assembly for sliding glass doors which provides a flexible coupling between a lock actuator or handle and the latch or lock assembly.

Yet another advantage of the present invention is that it provides an improved door hardware assembly for mounting mortise locks into sliding glass doors.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
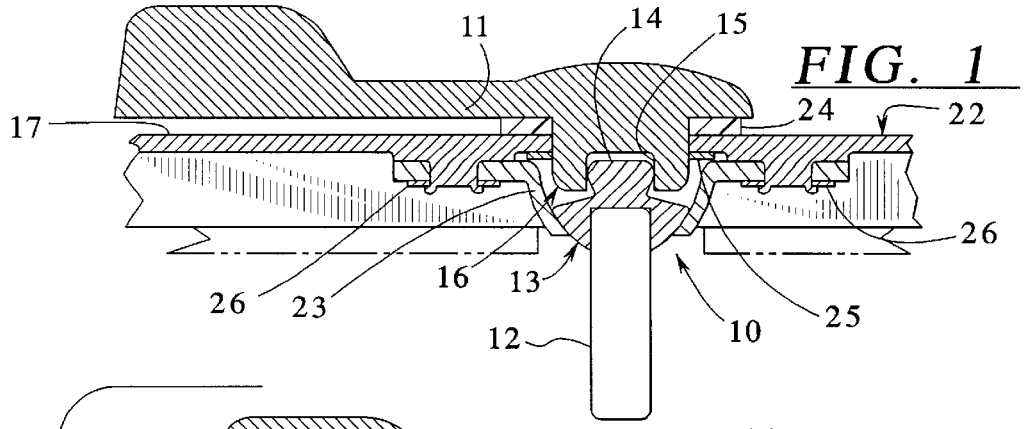
FIG. 1 is a sectional view of one embodiment of the flexible coupling of the present invention.
Figure 5:
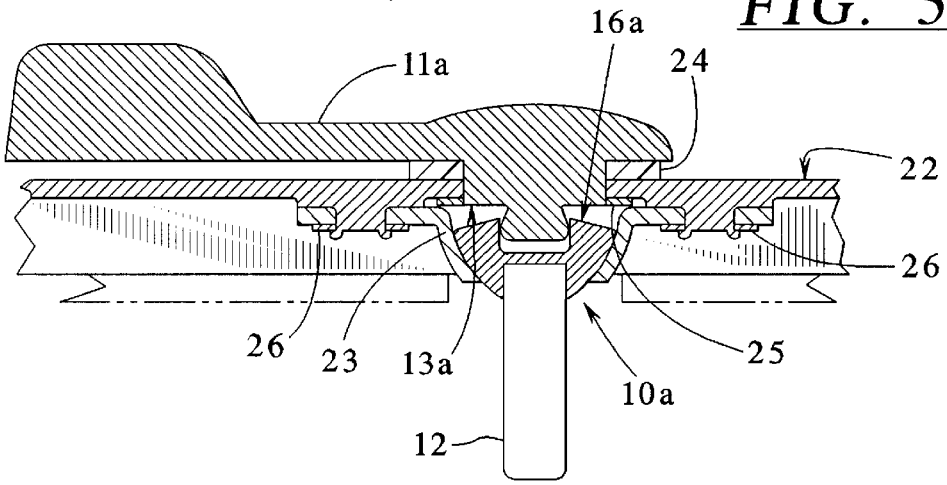
FIG. 5 is a sectional view of a third embodiment of the flexible coupling of the present invention.

Turning first to FIG. 1, a coupling mechanism 10 is illustrated which connects a handle or actuator 11 to a member 12 which, in turn, forms part of a latch assembly (not shown). The coupling mechanism 10 includes a male member 13 which comprises an outwardly protruding knuckle 14 which is received within a socket 15 of a female member 16. In the embodiment illustrated in FIG. 1, the female member 16 is integrally connected to the handle 11. As shown in FIG. 5, the male member 13*a* may also be connected to the handle 11*a* and the female member 16*a* may also be connected to the latch assembly component 12*a*.

Figure 2:
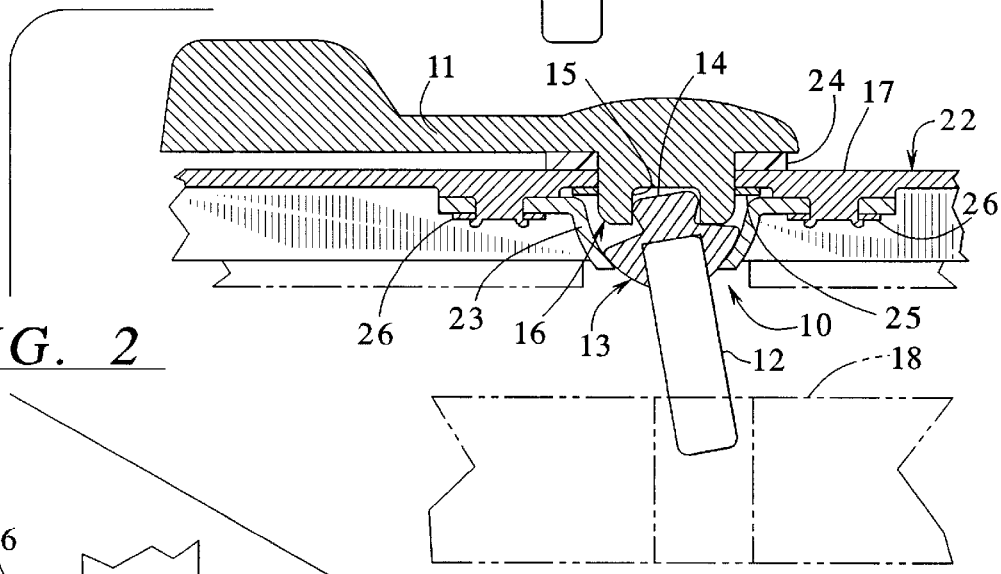
FIG. 2 in another sectional view of the flexible coupling shown in FIG. 1.

Turning to FIG. 2, the versatility provided by the coupling mechanism 10 is illustrated. Specifically, the female member 16, or the axial center thereof, may be mounted to the door frame 17 in an offset relationship with respect to the latch assembly shown at 18. This ability to mount the handle 11 and female member 16 in an offset relationship with respect to the latch assembly 18 is important for modem sliding glass doors which include a very narrow frame. A narrow frame results in a slim or narrow design for the latch assembly 18 and therefore the assembly 18 must be disposed in close proximity to the edge 21 of the door 22 (see FIG. 7). In order to place the handle in a central position on the frame 17, it is often necessary to mount the handle 11 in an offset relationship with respect to the latch assembly 18. Hence, the flexible coupling 10, 10*a* provided by the present invention as illustrated in FIGS. 1, 2 and 5 is of great advantage to the designers and installers of sliding doors like the one shown at 22 in FIG. 7.

Still referring to FIGS. 1 and 2, it will be noted that the female member 13 is supported in an bowl-shaped housing 23. Further, a washer 24 is provided between the handle 11 and the frame 17. The handle 11 is secured in place by a retaining ring 25 disposed inside of the frame 17. The housing 23 may be attached to the frame using similar retaining rings shown at 26. However, other suitable fastening methods will be apparent to those skilled in the art. It will be also noted that the latch assembly shown only schematically at 18 may be a mortise lock or a hook-shaped latch or other suitable locking mechanism for a sliding panel or sliding glass door.

Figure 3:
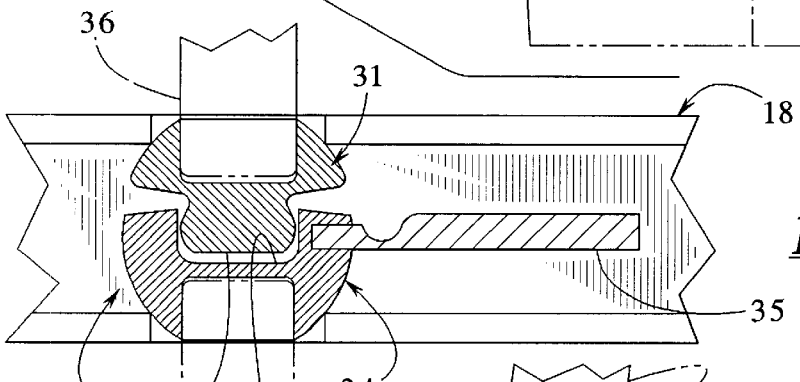
FIG. 3 is a sectional view of a second embodiment of the flexible coupling of the present invention.
Figure 4:
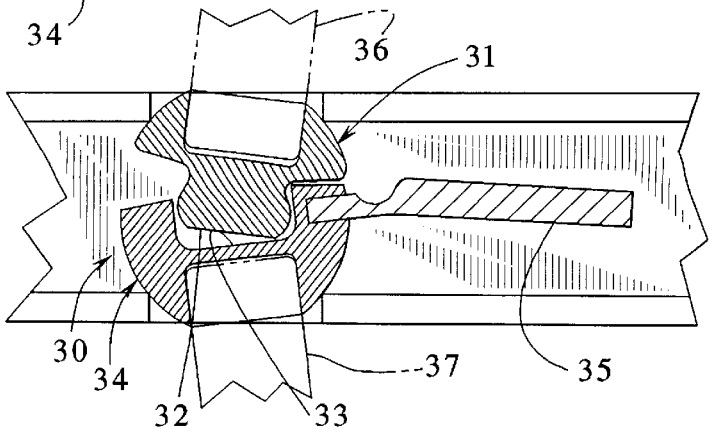
FIG. 4 is another sectional view of the flexible coupling shown in FIG. 3.

Turning to FIGS. 3 and 4, another coupling mechanism 30 is illustrated which, instead of being disposed outside of the latch mechanism 18, is disposed inside of the latch mechanism 18. The coupling 30 again includes a male member 31 with an outwardly protruding knuckle 32 that is disposed within a socket 33 of a female member 34. In the embodiment shown in FIG. 3, the female member 34 is connected to a member 35 which, in turn, moves the latch mechanism in a known manner between latched and unlatched positions in response to the rotary movement of the female member 34. The member shown in phantom at 36 may be connected either to the actuator disposed on the inside of the door or the outside of the door. Similarly, the member shown at 37 in phantom may also be connected to the actuator disposed inside of the door or outside of the door.

The advantages of the flexible coupling mechanism 30 shown in FIG. 3 are further illustrated in FIG. 4. Specifically, the actuators (not shown) which are connected to the members 36, 37 need not be mounted to the door (not shown) in an axially aligned relationship with the coupling 30. Instead, the actuator may be axially offset due to the ability of the coupling 30 to translate rotational movement even though the coupling 30 is bent in a position such as that shown in FIG. 4.

Figure 6:
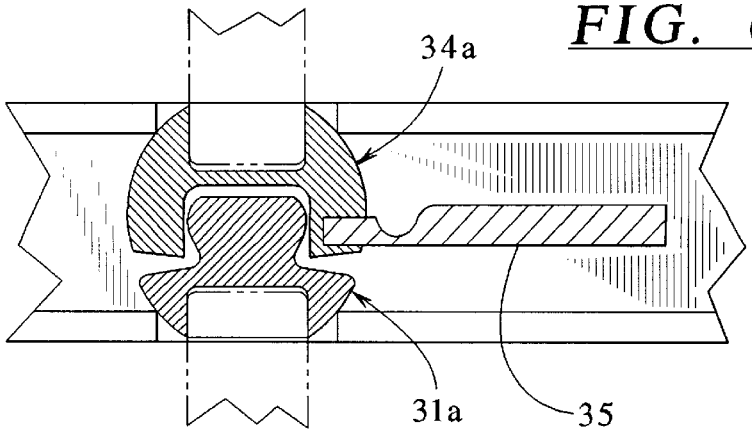
FIG. 6 is a sectional view of a fourth embodiment of the flexible coupling of the present invention.

In FIG. 4, it will be noted that the member 35 of the latch assembly is connected to the female member 34. However, as shown in FIG. 6, the member 35 may also be connected to the male member 31*a* as opposed to the female member 34*a*.

Figure 7:
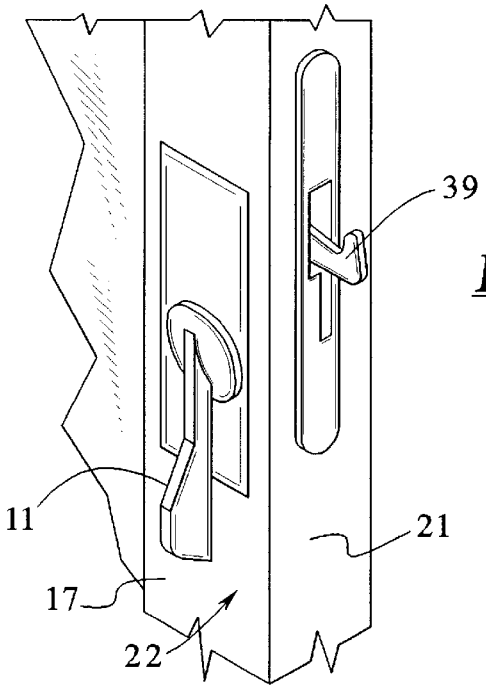
FIG. 7 is a partial perspective view of a lock made in accordance with the present invention as installed on a sliding glass door.

As shown in FIG. 7, the members 12 (see FIGS. 1 and 2) or 35 (see FIGS. 3 and 4) are part of a latch assembly that includes a latch member like that shown at 39. Of course, other embodiments are known to those skilled in the art and can be utilized with the coupling mechanisms 10, 10*a*, 30 and 30*a* as shown above.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A flexible coupling for a lock actuator and a latch assembly, the coupling comprising:

a male member comprising a semi-spherical base and an outwardly protruding knuckle portion that extends outward from the base, the base comprising an annular surface that encircles the knuckle, the knuckle being pivotally and frictionally captured in a cylindrical socket of a female member without a structural element connecting the knuckle to the socket, the knuckle comprising an outer periphery, the socket surrounding the outer periphery of the knuckle, the female member further comprising an outer rim defining an opening for the cylindrical socket, the outer rim abuttingly engaging the annular surface of the base of the male member when the male and female members are pivoted with respect to each other, the male member for attachment to one of the lock actuator or the latch assembly, the female member for attachment to the other of the lock actuator or latch assembly, wherein rotation of the male member results in rotation of the female member, the male member further being able to pivot with respect to the female member.

2. The coupling of claim 1 wherein the female member is for connecting to the lock actuator and the male member is for connecting to the latch assembly.

3. A lock for a gliding panel, the lock comprising:

an actuator, a latch assembly, and a flexible coupling for connecting the actuator to the latch assembly, the flexible coupling comprising a male member comprising a semi-spherical base and an outwardly protruding knuckle portion that extends outward from the base, the base comprising an annular surface that encircles the knuckle, the knuckle being pivotally and frictionally captured in a cylindrical socket of a female member without a structural element connecting the knuckle to the socket, the knuckle comprising an outer periphery, the socket surrounding the outer periphery of the knuckle, the female member further comprising an outer rim defining an opening for the cylindrical socket, the outer rim abuttingly engaging the annular surface of the base of the male member when the male and female members are pivoted with respect to each other, the female member being connected the actuator, the male member being connected to the latch assembly, wherein rotation of the actuator resulting in rotation of the male and female members and the latch assembly, the male member further being able to pivot with respect to the female member.

4. The coupling of claim 3 wherein the actuator comprises a handle and the latch assembly comprises a mortise lock.

5. The coupling of claim 3 wherein the actuator comprises a handle and the latch assembly comprises a hook shaped latch member.

6. A lock for a gliding panel, the lock comprising: an actuator, a latch assembly, and a flexible coupling for connecting the actuator to the latch assembly, the flexible coupling comprising a male member comprising a semi-spherical base and an outwardly protruding knuckle portion that extends outward from the base, the base comprising an annular surface that encircles the knuckle, the knuckle being pivotally and frictionally captured in a cylindrical socket of a female member without a structural element connecting the knuckle to the socket, the knuckle comprising an outer periphery, the socket surrounding the outer periphery of the knuckle, the female member further comprising an outer rim defining an opening for the cylindrical socket, the outer rim abuttingly engaging the annular surface of the base of the male member when the male and female members are pivoted with respect to each other, the female member being connected the latch assembly, the male member being connected to the actuator, wherein rotation of the actuator resulting in rotation of the male and female members and the latch assembly, the male member further being able to pivot with respect to the female member.

7. The coupling of claim 6 wherein the actuator comprises a handle and the latch assembly comprises a mortise lock.

8. The coupling of claim 6 wherein the actuator comprises a handle and the latch assembly comprises a hook shaped latch member.

* * * * *